US007237390B1

(12) United States Patent
Nelson

(10) Patent No.: US 7,237,390 B1
(45) Date of Patent: Jul. 3, 2007

(54) COMPACT PORTABLE BEVERAGE COOLING SYSTEM

(76) Inventor: Lance Nelson, 5 Rock Ave., Hudson, MA (US) 01749

( * ) Notice: Subject to any disclaimer, the term of this patent is extended or adjusted under 35 U.S.C. 154(b) by 88 days.

(21) Appl. No.: 11/111,237

(22) Filed: Apr. 21, 2005

(51) Int. Cl.
*F25B 21/02* (2006.01)

(52) U.S. Cl. ..... 62/3.64; 62/389

(58) Field of Classification Search ..... 62/3.64, 62/389–400, 3.6; 222/146.6
See application file for complete search history.

(56) References Cited

U.S. PATENT DOCUMENTS 3,865,276 A 2/1975 Thompson
4,320,626 A 3/1982 Donnelly
4,377,076 A * 3/1983 Staudt et al. ..... 62/395
5,537,825 A 7/1996 Ward
5,544,489 A 8/1996 Moren
5,584,188 A * 12/1996 Tippmann et al. ..... 62/239
6,112,541 A * 9/2000 Greene ..... 62/389
6,119,464 A 9/2000 Nakayama
6,131,393 A * 10/2000 Greene ..... 62/3.64
6,237,345 B1 * 5/2001 Kalman et al. ..... 62/3.64
RE37,696 E * 5/2002 Parker ..... 62/3.63
6,644,037 B2 * 11/2003 Busick et al. ..... 62/3.64

* cited by examiner

*Primary Examiner*—William E. Tapolcai
(74) *Attorney, Agent, or Firm*—Robert Nathans

(57) ABSTRACT

A cooling sink is positioned within a cooling chamber having a 0.75-1.50 gallon capacity, for directly contacting pressurized beer therein, the cooling sink having a substantial surface portion in contact with the beer for enabling heat extracted from said beer to be rapidly conveyed to said cooling device. The cooling sink has a deep trench therein for reducing the mass of the cooling portion while increasing the surface area contacting the beer. A valve is employed at the top of the cooling chamber to allow the cooling reservoir to be completely filled with beer during periods of use, and any developing undesired foam can be removed from time to time by opening this valve. Also, the pickup tube attached to the dispensing tap picks up beer from the bottom of the cooling chamber, to minimize foam in the beer dispensed.

3 Claims, 6 Drawing Sheets

COMPACT PORTABLE BEVERAGE COOLING SYSTEM

BACKGROUND OF THE INVENTION

The present invention relates to the field of beverage cooling and dispensing systems.

There is a need for a compact, portable, beer cooling and dispensing system that is coupled to a keg of beer that is delivered to the site of a social event. The dispensing system should have a proper size beer cooling chamber with a high thermal efficiency to rapidly cool down the beer whereby cold beer can be dispensed from time to time to people participating in the social event. It should also be sized and configured to be easily stored and carried from place to place.

One approach for cooling and dispensing cool beer stored in a keg involves placing the keg into a refrigerator to cool the entire keg. Another approach is to place the keg in a container of ice to cool the entire keg. These approaches for cooling the entire keg at once do not fulfill the objective of providing a relatively lightweight portable device for dispensing the desired limited amounts of cool beer from a warm keg of beer from time to time during the social event.

Thompson (U.S. Pat. No. 3,865,276) discloses a portable cooling dispenser that utilizes a conductive coil of tubing that is placed in a container filled with ice and ice water which cools the beer passing through the tubing to the dispensing tap. In environments such as parties during hot summer days, the ice will often not last through the length of time of the social event and the dispensed beer will not be adequately cooled. In contrast, our dispenser can provide cool beer for extended time periods, even for several days as it employs a small economical thermoelectric cooling device.

Another approach stores the keg at room temperature and a conduit transfers the beer to the dispensing tap which is cooled by a compressor type refrigeration system as disclosed in U.S. Pat. No. 2,638,758 to Duan. Such a compressor is relatively costly and cumbersome relative to our economical lightweight thermoelectric cooling device. Additionally, the amount of beer that is being cooled at one time has an insufficient volume to allow dispensing cold beer at a normal social gathering and thus warm beer will be dispensed.

In Nakayama et al., U.S. Pat. No. 6,119,464 a Peltier cooling plate is thermally coupled to a wall portion of a water cooling chamber via a cold side heat sink. Beer from a barrel is pressurized and is passed through a coil in the water bath to a dispensing tap. A mixing propeller is also shown. This is a more complex, bulky and costly arrangement than implementation of the present invention due to the coil positioned within the water bath and the mixing propeller. The cooling chamber of our most preferred embodiment of our invention is preferably no greater than 1.50 gallons for enhanced cooling efficiency, and due to its reduced size, the need for a mixing propeller and its drive motor has been eliminated to reduce manufacturing costs. In contrast with the Nakayama disclosure, a prototype of our invention is capable of cooling approximately one gallon of beer from room temperature to less than 39 degrees F. in less than ten minutes.

Moren, U.S. Pat. No. 5,544,489 unlike the present invention, is not concerned with dispensing beer under pressure; he does however disclose a metallic probe for directly cooling non-pressurized water in direct contact with the probe. Moren states at the bottom of col. 2 that the formation and retention of ice on his probe is carried out so that newly added liquid can be efficiently cooled. This approach was initially tested and found to be inefficient, probably due to the ice blocking transfer of heat from the beer to the metal (ice is a poor heat conductor), and thus we desired to avoid formation of ice on the cool sink contacting the beer, in contrast with the teachings of Moren. This was accomplished by designing the cold sink to increase the cold sink area in direct contact with the beer. Our novel heat sink configurations, compared to Moran's solid cylindrical rod, produced better rates of heat transfer to cool the beer faster, as it is needed during a social event.

BRIEF SUMMARY OF THE PREFERRED EMBODIMENT OF THE INVENTION

The objectives set forth above are met in accordance with the present invention, whereby a small portable beer cooling chamber very efficiently cools beer supplied from a keg to be dispensed over substantial time periods as needed. The cooling chamber has an upper port for receiving beer from the keg directly attached to the upper port or attached to the port by a conduit such as a hose, and a conventional beer dispensing tap dispenses the pressurized beer upwardly from the bottom of the cooling chamber. A special cooling heat sink directly contacts the beer, and is attached to the cold side of an electrical cooling device such as a thermoelectric cooling device. The special cooling sink also functions at the same time as a wall portion of the cooling chamber A high degree of thermal efficiency is provided by a combination of the proper sized cooling chamber and the special cooling heat sink having a cooling member affixed to the cold side of the thermoelectric cooling device and a beer cooling portion in direct contact with the body of beer within the cooling chamber, the cooling portion having a deep trench therein for reducing the mass of the cooling portion while increasing the surface area contacting the beer.

Assuming the average beer consumption rate at an ordinary social event, if the cooling chamber is too large, a small and thus economical thermoelectric cooler would not have time to cool the beer in the chamber to an adequate extent. If the cooling chamber is too small, assuming an average rate of consumption, the beer in the cooling chamber would tend to be dispensed too rapidly and thus be immediately displaced by warm beer from the keg, which would be served from the cooling chamber in short order. Our experimentation indicated that for best results, the cooling chamber should have a volume of between 0.75 and 1.5 gallons. The pressure of the beer within the cooling chamber is maintained either by a hand pump or a pressure tank filled with gas such as carbon dioxide. A valve is employed at the top of the cooling chamber to allow the cooling reservoir to be completely filled with beer during periods of use, and any developing undesired foam can be removed from time to time by opening this valve. Also, the pickup tube attached to the dispensing tap picks up beer from the bottom of the cooling chamber, to minimize foam in the beer dispensed.

BRIEF DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENTS OF THE INVENTION

Figure 1:
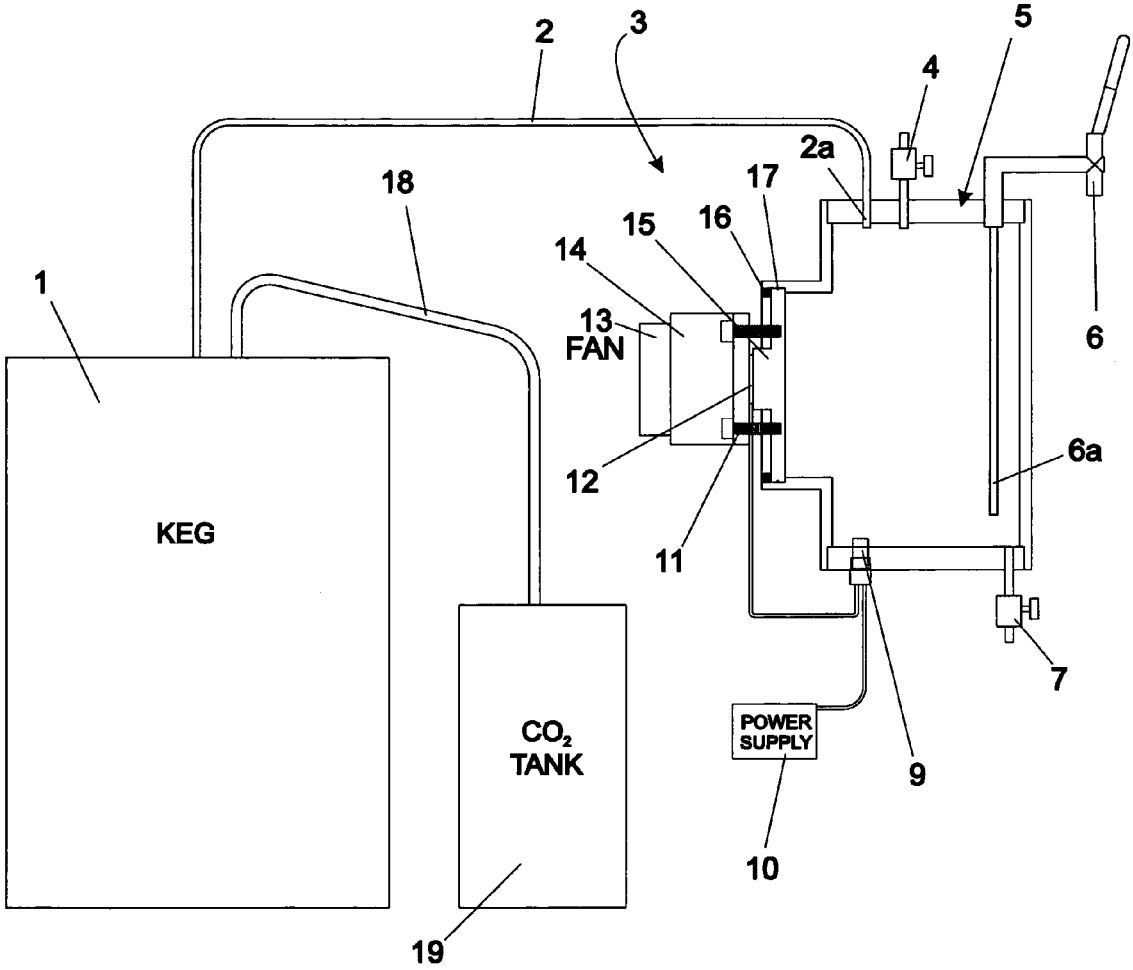
FIG. 1 discloses the overall arrangement of the cooling system.
Figure 2:
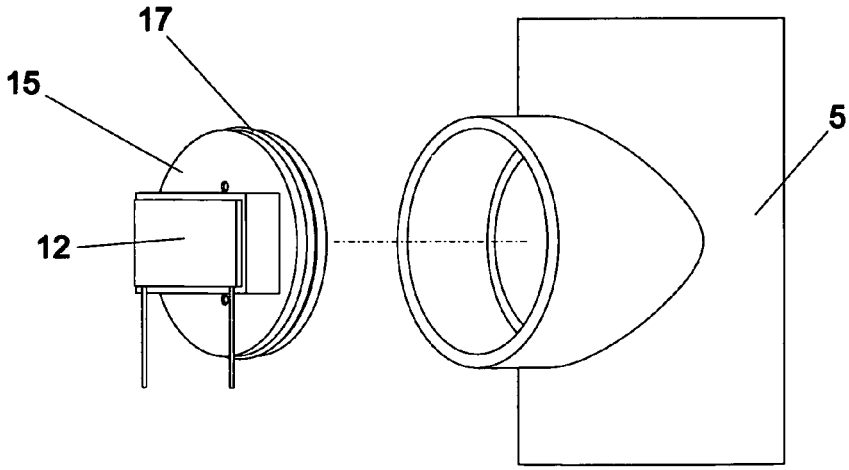
FIGS. 2-5 illustrate the most preferred finalized cooling sink design of the invention.

Referring to FIG. 1, cooling chamber 5 is coupled to a keg of beer 1 via hose 2 and an upper input port 2*a*. A propellant gas tank 19 and hose 18 forces the beer under pressure into the cooling chamber and beer is disbursed from the cooling chamber via pickup tube 6*a* and tap 6 in the conventional manner. Alternatively, the cooling chamber can be coupled directly to the top of the keg to function as a hand pumped "picnic type" dispenser. Both of these dispensing arrangements are conventional. An electrical Peltier cooling device 12 is thermally coupled between cold side cool sink 15 and hot side heat sink 14 shown also in FIG. 6 with its cooling fins. Screws 11 attach the heat sink to the cool sink. Annular member 16 retains the cold sink in position so that pressurized beer does not push the cold sink out of the cooling chamber. A fan 13 may assist dispersion of heat from the hot side heat sink into the atmosphere by directing air upon the fins. The power supply 10 is connected to the electrical cooling device 12 via temperature control probe 9 to energize it.

Relief valve 4 is positioned at an upper portion of said cooling chamber 5 for removing air at upper portions of the cooling chamber, allowing the cooling chamber to be completely filled with beer during periods of use while enabling undesirable foam to be removed from said cooling chamber from time to time to time. Valve 7 is employed to conveniently drain the chamber before cleaning after use. Beer pickup tube 6*a* has its inlet portion positioned at the bottom of the cooling chamber for minimizing foam in the beer being disbursed.

Assuming the average beer consumption rate at an ordinary social event, if the cooling chamber is too large, a small and thus economical thermoelectric cooler would not have time to cool the beer in the chamber to an adequate extent. If the cooling chamber is too small, assuming an average rate of consumption, the beer in the cooling chamber would tend to be dispensed too rapidly and thus be immediately displaced by warm beer from the keg, which would be served from the cooling chamber too quickly. We determined that, for best results, the cooling chamber should have a volume of between 0.75 and 1.5 gallons. However we believe that fairly good results would also be obtained if the cooling chamber had a capacity of between 0.5 and 2.0 gallons which would still be appropriate for a compact portable beer cooler, in contrast with larger non-portable coolers employed in bars and restaurants.

In order to be able to employ smaller thermoelectric cooling devices to reduce manufacturing costs, without losing the desired rapid cooling of the beer dispensed during a social event, we determined that having the cooling member of the heat sink in direct contact with the beer was the best approach. This approach was used by Moren in U.S. Pat. No. 5,544,489 which disclosed a solid rod heat absorbing probe member immersed in the body of beer, and we found that the cool down rate of the beer in the cooling chamber was disappointing.

Figure 6:
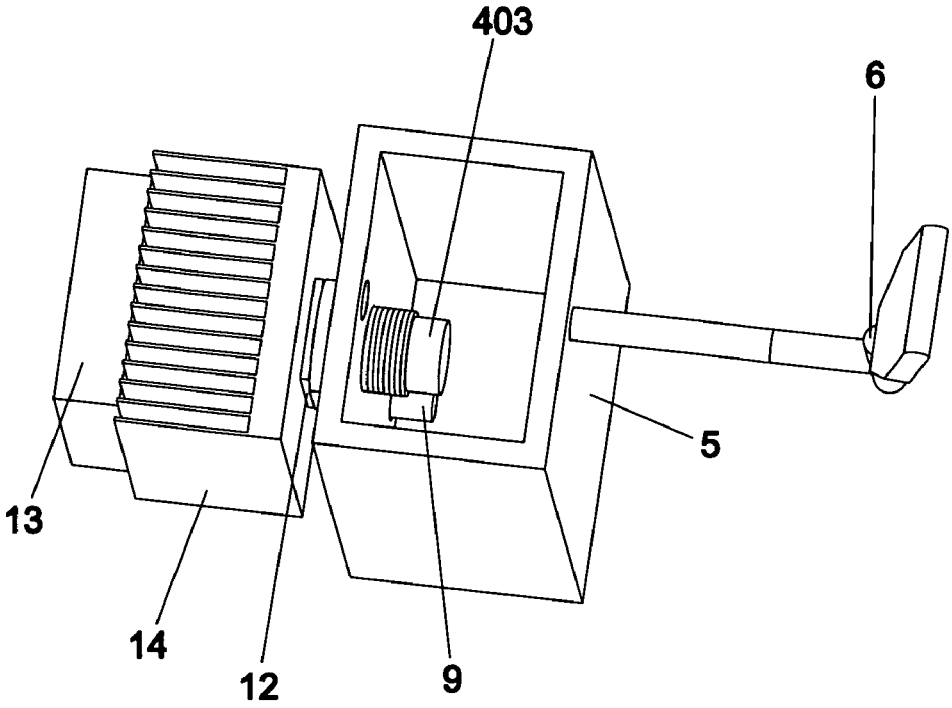
FIGS. 6-8 illustrate a first cooling sink design.
Figure 7:
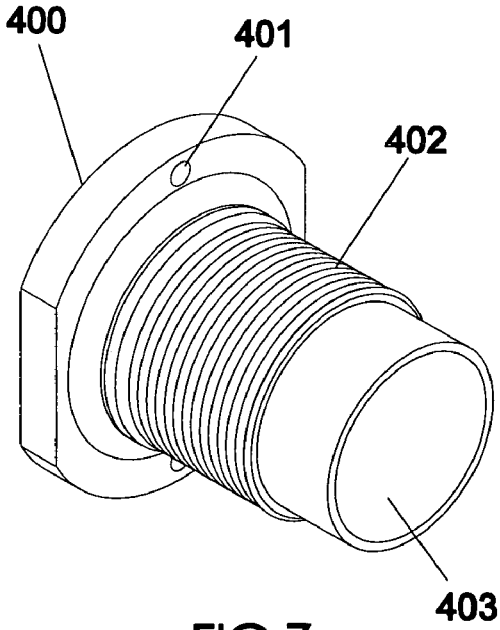
Figure 8:
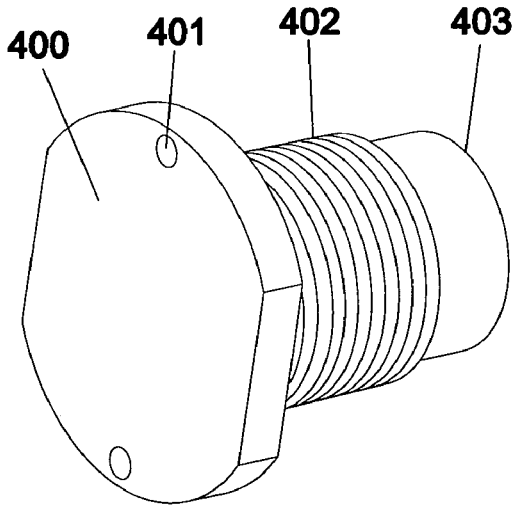

While the cool side heat sink 15 could be a flat wall of the cooling chamber as shown in FIG. 1, our experiments led us to a probe-like cold side sink portion 403 shown in FIGS. 6-8, which was constructed as a hollow cylindrical tube. The threads 402 enable the cylinder 403 to be screwed into the cooling chamber wall to provide a pressure seal to maintain the beer within the cooling chamber. The flat surface 400 that contacts the thermoelectric cooling device has bolt holes 401 for thermally coupling the cold sink to the thermoelectric cooling device. The use of a hollow cylinder was an attempt to increase the surface area relative to the aforesaid solid rod Moren probe.

Figure 9:
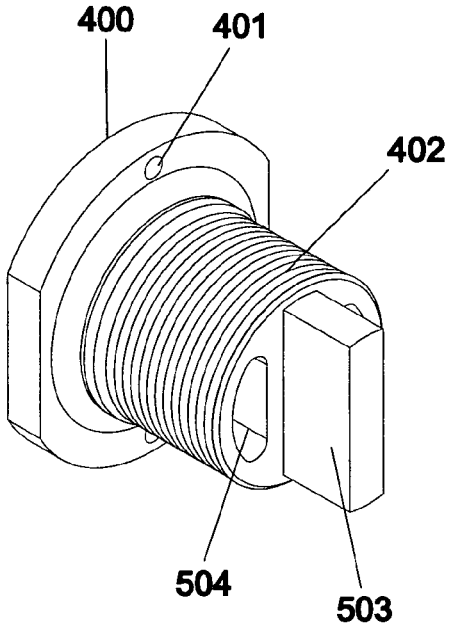
FIGS. 9 and 10 illustrate a second cooling sink design.
Figure 10:
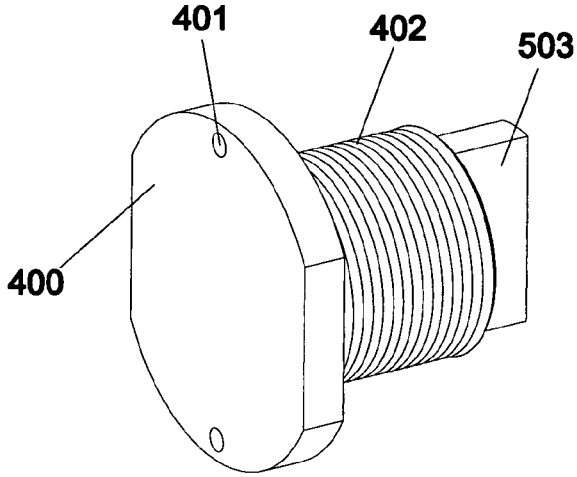

Then we tested a cold sink projection member of FIGS. 9 and 10 having a flat member 503 extending into the cooling chamber to a lesser extent than the hollow cylinder and found there was some improvement in the thermal efficiency. A hollowed out portion 504 was formed to attempt to lessen the mass of the cold sink.

Figure 3:
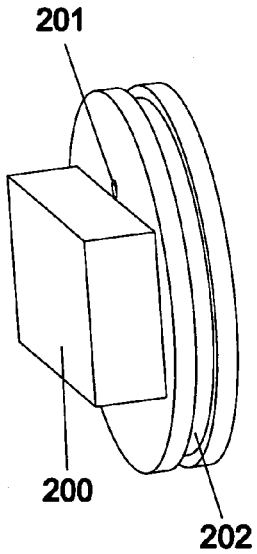
Figure 4:
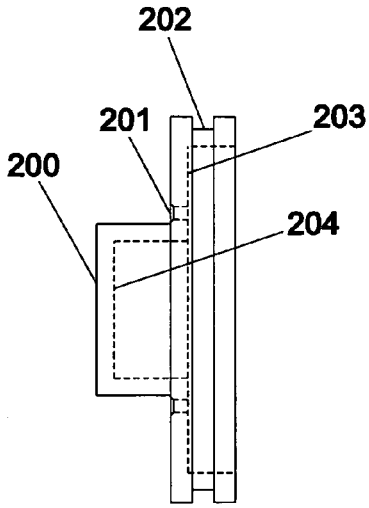
Figure 5:
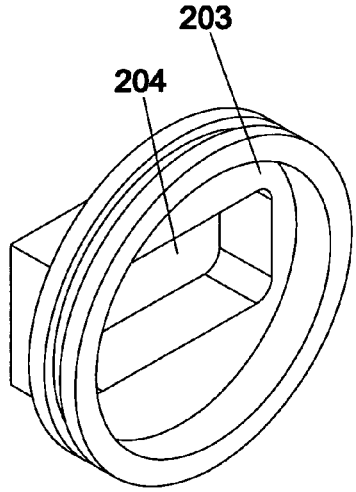

We then tried to further improve on the heat sink cooling members by eliminating the use of the projection member of FIGS. 9 and 10 extending into the cooling chamber, and built and tested the cooling member shown in FIGS. 3-5, wherein the cooling portion of the heat sink contacting the beer has a deep trench formed in its flat surface.

In this preferred embodiment, the cooling portion of the heat sink 203 contacting the beer has a hollowed out trench 204 formed within cold sink block 200 in turn coupled to the Peltier cooling device 12 as shown in FIG. 1. The hot side heat sink 14 and fan 13 are attached to the cold sink by screws 11 that thread into holes 201 shown in FIGS. 3 and 4. The Peltier cooling device 12 is sandwiched between the hot side heat sink 14 and the cold sink 15. A sealing O-ring 17 is fitted into the depressed annular rim portion 202. This cooling assembly is then pressed into a hole in the side of the cooling chamber 5 and held in place via a retaining mechanism 16 which could consist of a glued-in stop, a c-clip, snap ring or other device. The retaining mechanism prevents the pressure on the inside of the cooling chamber from pushing the cold side heat sink 15 out of the cooling chamber.

Good thermal efficiency was obtained, thus enabling the use of a smaller economical thermoelectric cooling device without sacrificing the desired fast cool down rate of the beer. It is believed that the deep trench formed in the flat surface of the cool sink 203 contacting the beer reduces the mass of the cool side heat sink which results in heat being rapidly conveyed to the cold side of the thermoelectric device without accumulating in the heat sink to impede cooling of the beer. Additionally, the surface area of the currently most preferred heat sink of FIGS. 3-5 is greater than the surface area of most of the other embodiments to contribute to good thermal efficiency.

This final design of FIGS. 3-5 provided substantially greater cooling efficiencies than the Moren probe or our earlier prototypes described above. Ice formation was observed in the hole 504 of the less desired FIG. 9 embodiment. However, ice formation was eliminated in our final design of FIGS. 3-5. We thus concluded that the production of ice on the prior sink designs, which Moren felt to be important in his probe design as mentioned in the background section above, was a detriment rather than an advantage.

Figure 11:
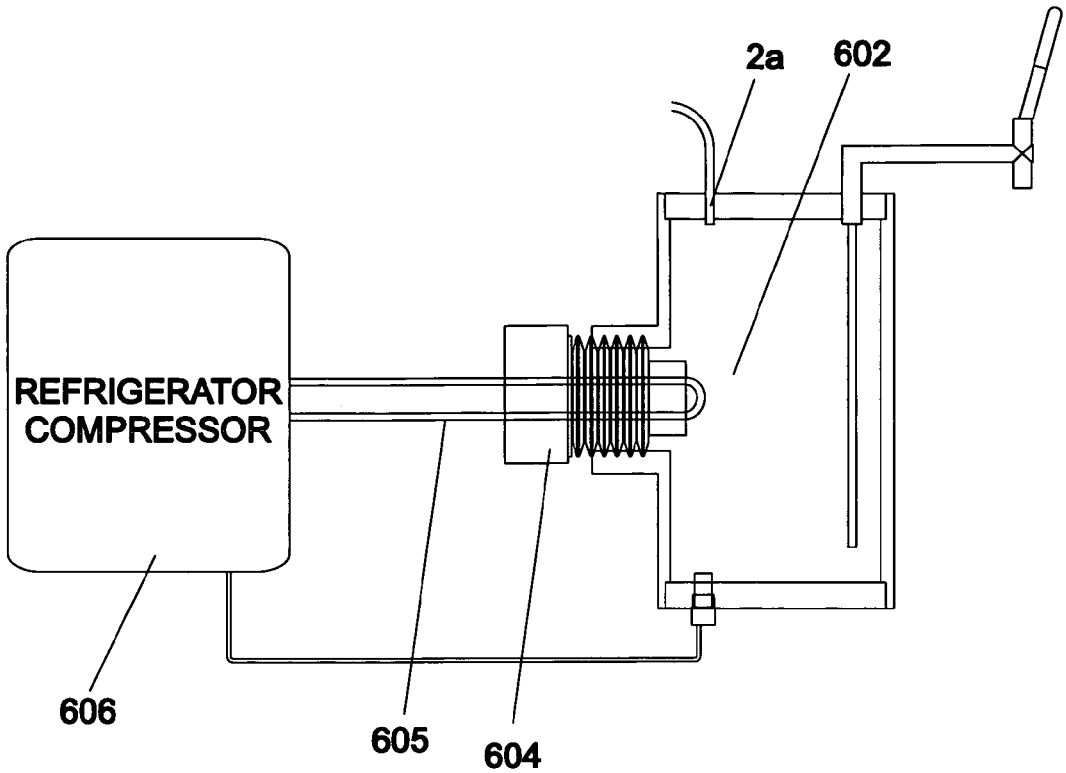
FIG. 11 is a cross sectional view of the beverage cooling system showing a standard evaporator compressor refrigeration system with a refrigerant coil contacting a cold sink to provide cooling.

FIG. 11 incorporates a miniature evaporator refrigerator compressor 606 as the electrical cooling device which cools the cold side heat sink 604 and the beer within the cooling chamber 602. The refrigerant coil 605 which carries the compressor's cooling medium, such as "Freon" refrigerant, contacts the cold side heat sink 604 which is in direct contact with the beer. This refrigerant coil could be used to cool any of the various embodiments of the cold side heat sink.

Figure 12:
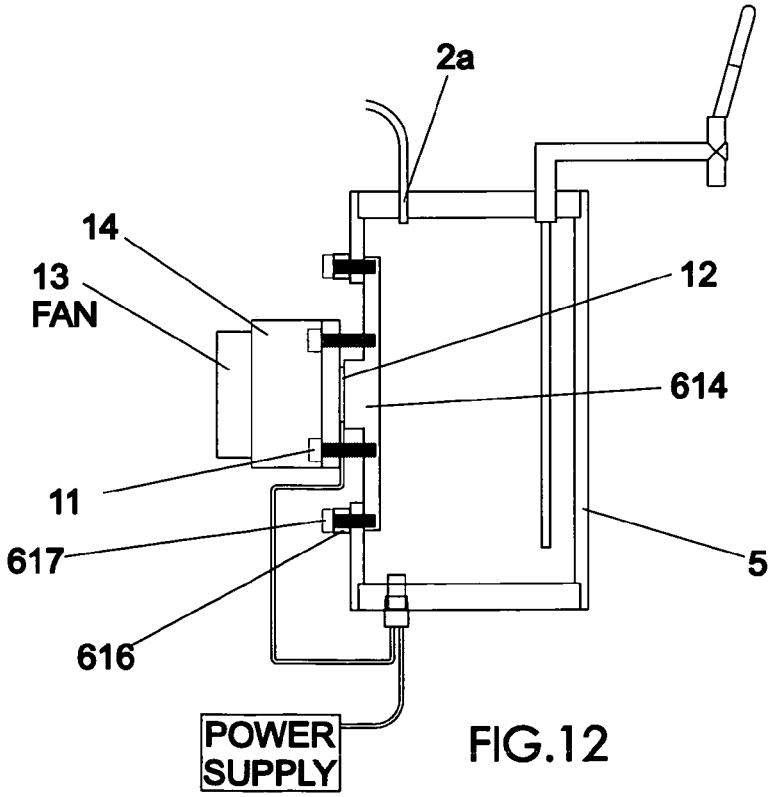
FIG. 12 is a cross sectional view of the beverage cooling system showing a flange with screws holding the cold side heat sink against the wall of the container.
Figure 13:
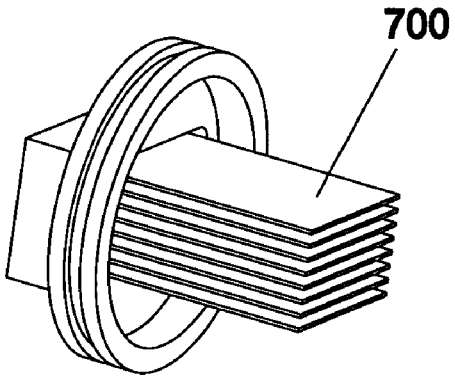
FIG. 13 and FIG. 14 show the cold side heat sink with additional fins attached to the side that is in direct contact with the beer.
Figure 14:
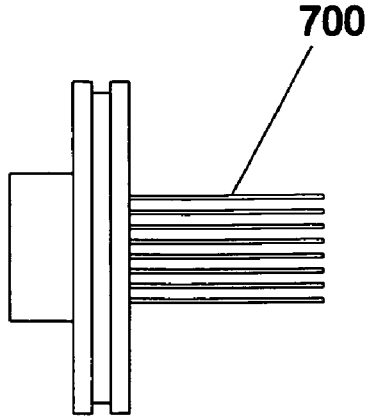
Figure 15:
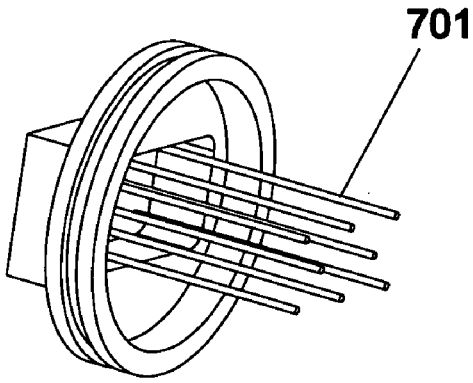
FIG. 15 and FIG. 16 show the cold side heat sink with additional pins or wires attached to the side that is in direct contact with the beer.
Figure 16:
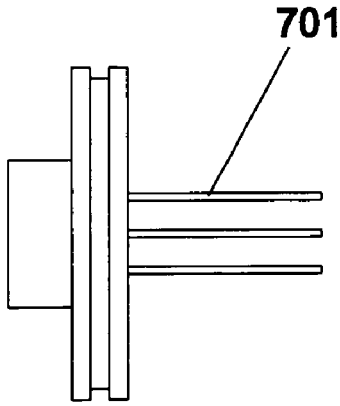

FIG. 12 depicts a cold side heat sink 614 serving as one of the walls of the cooling chamber 5 and in direct contact with the beer. An annular flange 616 compresses the cold side heat sink against the wall of the cooling chamber with screws 617 to provide a pressure seal to contain the beer within the cooling chamber. The remaining components are as previously described.

FIGS. 13-16 show additional embodiments of the cold sink. Fins 700 or pins or wires 701 can be attached to the side of the cold side heat sink that directly contacts the beer. These thin fins, pins or wires beneficially have very little mass and, although more expensive to manufacture, increase the surface area of the cold side heat sink which contacts the beer.

The best thermal efficiency was provided by our final preferred design by a cooling chamber having a volume of between about 0.75 and 1.50 gallons and by a special cooling heat sink in direct contact with the body of beer within the cooling chamber, the special cooling sink having a deep trench therein for increasing the cool sink surface area contacting the beer to enhance heat conductivity. The surface area is enhanced by virtue of the added area of its side portions. Reduction in the mass of the cold sink by virtue of the deep trench is also believed to be significant in enhancing efficiency, as it is desirable to expedite conveyance of heat away from the cold side heat sink in contact with the beer to be dissipated by the thermoelectric device. Hence this "low mass" feature deters storage of heat in cooling sink components contacting the beer. It may be noted that the cooling sink portions 15 of FIGS. 1 through 6 and sink portion 614 of FIG. 12, also have a beneficial double function as they act as wall portions of the cooling chamber. Also, as these cooling sink portions do not extend into the cooling chamber, they tend to deter storage of heat in cooling sink components contacting the beer.

While the invention has been described in connection with preferred embodiments, the description is not intended to limit the scope of the invention to the particular forms set forth, but on the contrary, it is intended to cover such alternatives, modifications, and equivalents as may be included within the spirit and scope of the invention as defined by the appended claims. For example, the term "electrical cooling device" as used in the claims is intended to include any electrical cooling device such as a Peltier device, a Sterling cooler, or even a miniature refrigerator compressor. The material having a high degree of heat conductivity includes but is not limited to aluminum, stainless steel and copper. While a single trench in the cold sink is preferable, a plurality of trenches or equivalent indentations may be provided to enhance the surface area of the cooling sink contacting the beer.

What is claimed is:

1. Apparatus for dispensing beer from a beer keg to be consumed during a social event comprising:

(a) a cooling chamber having a capacity specifically designed to hold 0.50 to 2.0 gallons of beer and having an inlet port, enabling said cooling chamber to be coupled to said keg via a liquid conduit, and dispensing means for serving the beer;

(b) an electrical cooling means;

(c) a cooling sink, thermally coupled to said electrical cooling means, made of a material having a high degree of heat conductivity, positioned within said cooling chamber, for directly contacting beer therein, said cooling sink having a substantial surface portion in contact with said beer for enabling heat extracted from said beer to be rapidly conveyed to said cooling means; and (d) pressurizing means for pressurizing said beer within said cooling chamber, enabling the beer to be dispensed from said cooling chamber by said dispensing means; and (e) a relief valve positioned at an upper portion of said cooling chamber for removing air at upper portions of said cooling chamber, allowing the cooling chamber to be completely filled with beer during periods of use while enabling undesirable foam to be removed from said cooling chamber from time to time to time, and (f) wherein said dispensing means includes a beer pickup tube having an inlet portion positioned at the bottom of the cooling chamber for minimizing foam in beer being dispensed.

2. Apparatus for dispensing beer from a beer keg to be consumed during a social event comprising:

(a) a cooling chamber having a capacity specifically designed to hold 0.75 to 1.5 gallons of beer and having an inlet port, enabling said cooling chamber to be coupled to said keg via a liquid conduit, and dispensing means for serving the beer;

(b) an electrical cooling means;

(c) a cooling sink, thermally coupled to said electrical cooling means, made of a material having a high degree of heat conductivity, positioned within said cooling chamber, for directly contacting beer therein, said cooling sink having a substantial surface portion in contact with said beer for enabling heat extracted from said beer to be rapidly conveyed to said cooling means; and (d) pressurizing means for pressurizing said beer within said cooling chamber, enabling the beer to be dispensed from said cooling chamber by said dispensing means; and (e) a relief valve positioned at an upper portion of said cooling chamber for removing air at upper portions of said cooling chamber, allowing the cooling chamber to be completely filled with beer during periods of use while enabling undesirable foam to be removed from said cooling chamber from time to time to time, and (f) wherein said dispensing means includes a beer pickup tube having an inlet portion positioned at the bottom of the cooling chamber for minimizing foam in beer being dispensed.

3. Apparatus for dispensing beer from a beer keg to be consumed during a social event comprising:

(a) a cooling chamber having a capacity specifically designed to hold 0.50 to 2.0 gallons of beer and having an inlet port, enabling said cooling chamber to be coupled to said beer keg via a liquid conduit, and dispensing means for serving the beer;

(b) a thermoelectric cooling device having a cold sink and a hot sink;

(c) said cold sink configured as a cold sink wall portion of said cooling chamber and being made of a mass of material having a high degree of heat conductivity for directly contacting beer therein without an intermediate member, said cold sink wall portion having a substantial surface portion in direct contact with said beer for enabling heat extracted from said beer to be rapidly conveyed through said thermoelectric cooling device via said cold sink; and (d) pressurizing means for pressurizing said beer within said cooling chamber, enabling the beer to be dispensed from said cooling chamber by said dispensing means;

(e) a relief valve positioned at an upper portion of said cooling chamber for removing air at upper portions of said cooling chamber allowing the cooling chamber to be completely filled with beer during periods of use while enabling undesirable foam to be removed from said cooling chamber from time to time to time; and (f) wherein said dispensing means includes a beer pickup tube having an inlet portion positioned at the bottom of the cooling chamber for minimizing foam in beer being dispensed.

* * * * *